US008641030B2

(12) United States Patent
Sato

(10) Patent No.: US 8,641,030 B2
(45) Date of Patent: Feb. 4, 2014

(54) CONTROL APPARATUS FOR CONTROLLING STAPLING AND IMAGE FORMING APPARATUS FOR CONTROLLING STAPLING

(75) Inventor: Hirochika Sato, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 100 days.

(21) Appl. No.: 13/448,129

(22) Filed: Apr. 16, 2012

(65) Prior Publication Data

US 2012/0267842 A1 Oct. 25, 2012

(30) Foreign Application Priority Data

Apr. 19, 2011 (JP) ..... 2011-093275

(51) Int. Cl.
*B65H 37/04* (2006.01)

(52) U.S. Cl.
USPC ..... 270/58.09; 270/58.11; 399/410

(58) Field of Classification Search
USPC ..... 270/58.09, 58.08, 58.11, 58.12, 58.17, 270/58.18
See application file for complete search history.

(56) References Cited

U.S. PATENT DOCUMENTS

| | | | | |
|---|---|---|---|---|
| 5,187,534 | A * | 2/1993 | Iwata et al. | 399/410 |
| 6,550,757 | B2 * | 4/2003 | Sesek | 270/58.09 |
| 6,595,509 | B2 * | 7/2003 | Sesek | 270/58.09 |
| 7,281,707 | B2 * | 10/2007 | Moriyama et al. | 270/58.04 |
| 7,690,633 | B2 * | 4/2010 | Tamura et al. | 270/37 |
| 7,753,353 | B2 * | 7/2010 | McNamara | 270/37 |
| 8,146,906 | B2 * | 4/2012 | Sugihara | 270/52.18 |
| 8,177,214 | B2 * | 5/2012 | Sato | 270/58.09 |
| 8,226,079 | B2 * | 7/2012 | Ozawa | 270/58.09 |

FOREIGN PATENT DOCUMENTS

JP 11-192766 A 7/1999

* cited by examiner

*Primary Examiner* — Patrick Mackey
(74) *Attorney, Agent, or Firm* — Canon U.S.A., Inc., IP Division

(57) ABSTRACT

A control apparatus that controls a stapling unit configured to staple sheets includes a control unit configured to determine a turning-over direction of sheets to be stapled by the stapling unit and to determine a maximum number of staplable sheets according to the determined turning-over direction.

13 Claims, 7 Drawing Sheets

UPWARD STAPLING ON RECORDING PAPER

DOWNWARD STAPLING ON RECORDING PAPER

FIG.3A
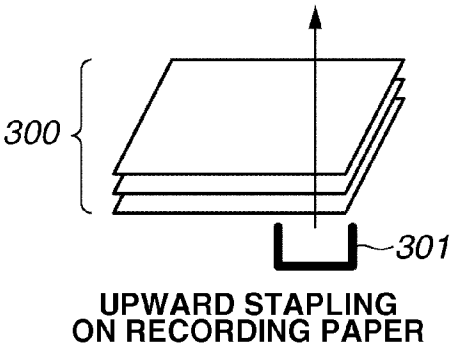
FIG.3B
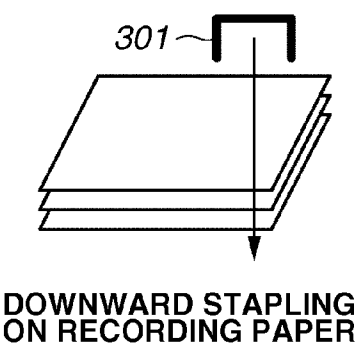
FIG.3C
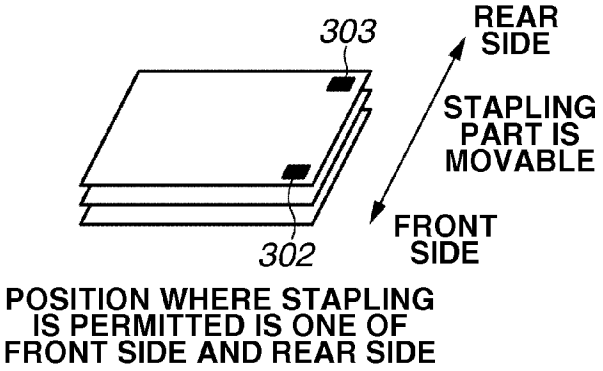
FIG.3D
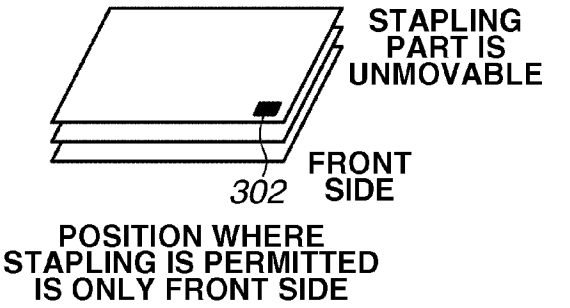
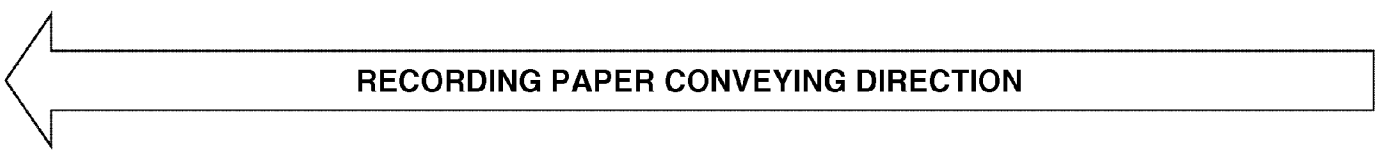

FIG.4

| STAPLING DIRECTION INFORMATION | POSSIBLE STAPLING POSITION INFORMATION | DOCUMENT IMAGE DIRECTION INFORMATION | STAPLING POSITION DESIGNATION INFORMATION | STAPLING POSITION | STAPLING DIRECTION |
|---|---|---|---|---|---|
| UPWARD ON RECORDING PAPER STACK | ONLY FRONT SIDE | PORTRAIT | UPPER RIGHT SIDE | STAPLING AT FRONT SIDE | BACKWARD DIRECTION |
| | | | LOWER RIGHT SIDE | STAPLING AT FRONT SIDE | FORWARD DIRECTION |
| | | | UPPER LEFT SIDE | STAPLING AT FRONT SIDE | FORWARD DIRECTION |
| | | | LOWER LEFT SIDE | STAPLING AT FRONT SIDE | BACKWARD DIRECTION |
| | | LANDSCAPE | UPPER RIGHT SIDE | STAPLING AT FRONT SIDE | FORWARD DIRECTION |
| | | | LOWER RIGHT SIDE | STAPLING AT FRONT SIDE | BACKWARD DIRECTION |
| | | | UPPER LEFT SIDE | STAPLING AT FRONT SIDE | BACKWARD DIRECTION |
| | | | LOWER LEFT SIDE | STAPLING AT FRONT SIDE | FORWARD DIRECTION |
| | PERMITTED AT REAR SIDE | PORTRAIT | UPPER RIGHT SIDE | STAPLING AT REAR SIDE | FORWARD DIRECTION |
| | | | LOWER RIGHT SIDE | STAPLING AT FRONT SIDE | FORWARD DIRECTION |
| | | | UPPER LEFT SIDE | STAPLING AT FRONT SIDE | FORWARD DIRECTION |
| | | | LOWER LEFT SIDE | STAPLING AT REAR SIDE | FORWARD DIRECTION |
| | | LANDSCAPE | UPPER RIGHT SIDE | STAPLING AT FRONT SIDE | FORWARD DIRECTION |
| | | | LOWER RIGHT SIDE | STAPLING AT REAR SIDE | FORWARD DIRECTION |
| | | | UPPER LEFT SIDE | STAPLING AT REAR SIDE | FORWARD DIRECTION |
| | | | LOWER LEFT SIDE | STAPLING AT FRONT SIDE | FORWARD DIRECTION |
| DOWNWARD ON RECORDING PAPER STACK | ONLY FRONT SIDE | PORTRAIT | UPPER RIGHT SIDE | STAPLING AT FRONT SIDE | FORWARD DIRECTION |
| | | | LOWER RIGHT SIDE | STAPLING AT FRONT SIDE | BACKWARD DIRECTION |
| | | | UPPER LEFT SIDE | STAPLING AT FRONT SIDE | BACKWARD DIRECTION |
| | | | LOWER LEFT SIDE | STAPLING AT FRONT SIDE | FORWARD DIRECTION |
| | | LANDSCAPE | UPPER RIGHT SIDE | STAPLING AT FRONT SIDE | BACKWARD DIRECTION |
| | | | LOWER RIGHT SIDE | STAPLING AT FRONT SIDE | FORWARD DIRECTION |
| | | | UPPER LEFT SIDE | STAPLING AT FRONT SIDE | FORWARD DIRECTION |
| | | | LOWER LEFT SIDE | STAPLING AT FRONT SIDE | BACKWARD DIRECTION |
| | PERMITTED AT REAR SIDE | PORTRAIT | UPPER RIGHT SIDE | STAPLING AT REAR SIDE | FORWARD DIRECTION |
| | | | LOWER RIGHT SIDE | STAPLING AT FRONT SIDE | FORWARD DIRECTION |
| | | | UPPER LEFT SIDE | STAPLING AT FRONT SIDE | FORWARD DIRECTION |
| | | | LOWER LEFT SIDE | STAPLING AT REAR SIDE | FORWARD DIRECTION |
| | | LANDSCAPE | UPPER RIGHT SIDE | STAPLING AT FRONT SIDE | FORWARD DIRECTION |
| | | | LOWER RIGHT SIDE | STAPLING AT REAR SIDE | FORWARD DIRECTION |
| | | | UPPER LEFT SIDE | STAPLING AT REAR SIDE | FORWARD DIRECTION |
| | | | LOWER LEFT SIDE | STAPLING AT FRONT SIDE | FORWARD DIRECTION |

FIG.5A

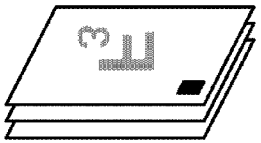

DOCUMENT IMAGE = PORTRAIT
PRINT SETTING = STAPLING ON UPPER LEFT SIDE
STAPLING DIRECTION = DOWN → UP
POSSIBLE STAPLING POSITION = ONLY FRONT SIDE
→
DISCHARGING OF PAPER IN PAGE
ASCENDING ORDER WITH FACE-DOWN

FIG.5B

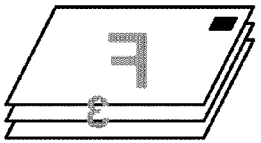

DOCUMENT IMAGE = LANDSCAPE
PRINT SETTING = STAPLING ON UPPER LEFT SIDE
STAPLING DIRECTION = DOWN → UP
POSSIBLE STAPLING POSITION = ALSO PERMITTED ON REAR SIDE
→
DISCHARGING OF PAPER IN PAGE
ASCENDING ORDER WITH FACE-DOWN

FIG.5C

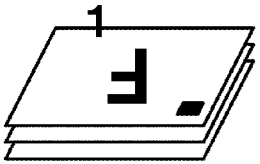

DOCUMENT IMAGE = LANDSCAPE
PRINT SETTING = STAPLING ON UPPER LEFT SIDE
STAPLING DIRECTION = DOWN → UP
POSSIBLE STAPLING POSITION = ONLY FRONT SIDE
→
DISCHARGING OF PAPER IN PAGE
DESCENDING ORDER WITH FACE-UP

FIG.5D

PAPER TURNING-OVER
DIRECTION BY USER

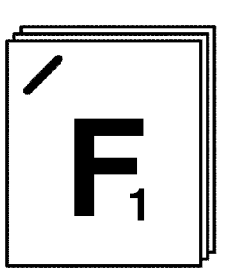

STAPLING RESULT OF FIG. 5A
STAPLE ON SURFACE OF 1ST PAGE

FIG.5E

PAPER TURNING-OVER
DIRECTION BY USER

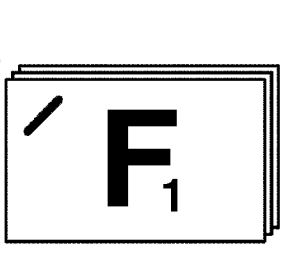

STAPLING RESULT OF FIG. 5B
STAPLE ON SURFACE OF 1ST PAGE

FIG.5F

PAPER TURNING-OVER
DIRECTION BY USER

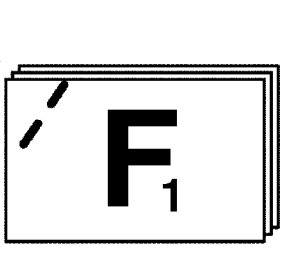

STAPLING RESULT OF FIG. 5C
STAPLE FROM REAR SIDE ON
SURFACE OF 1ST PAGE

CONTROL APPARATUS FOR CONTROLLING STAPLING AND IMAGE FORMING APPARATUS FOR CONTROLLING STAPLING

BACKGROUND OF THE INVENTION

1. Field of the Invention

The present invention relates to a control apparatus that controls stapling and an image forming apparatus that performs stapling.

2. Description of the Related Art

Conventionally, there has been provided an image forming apparatus that has a staple setting as one of print settings. In such an image forming apparatus, a user can set a stapling position indicating which of four corners and upper and lower sides of a print product is stapled via a printer driver screen of a personal computer (PC) or an operation unit of the image forming apparatus.

However, there is an upper limit to the number of staplable sheets by one staple on a set of recording papers that is a print product. Many image forming apparatuses store maximum numbers of staplable sheets as fixed values in storage units, and do not execute stapling when the numbers of recording sheets exceed the maximum number of staplable sheets.

Japanese Patent Application Laid-Open No. 11-192766 discusses an image forming apparatus that performs control to bind recording sheets as many as possible by one staple by varying the maximum number of staplable sheets based on quality of the recording sheets to be stapled and characteristics of the staple.

In the conventional technology, however, the maximum number of staplable sheets is fixed irrespective of a stapling direction on the set of recording papers. As a result, depending on a stapling direction, strength of stapling is lower even on the same set of recording papers.

Specifically, as illustrated in FIG. 7, when first to last pages are stapled on the upper left side of a set of sheets 501 including three recording sheets on which the image forming apparatus has printed landscape images, a possibility that the sheets will be easily unstapled is low even if the user turns over the sheets upward and obliquely to the left.

On the other hand, when last to first pages are stapled on the upper left side of a set of sheets 502 including three recording sheets on which the image forming apparatus has printed landscape images, a possibility that the sheets will be easily unstapled becomes high if the user turns over the sheets upward and obliquely to the left.

Thus, at the stapling position, depending on a turning-over direction of the set of sheets to be stapled, the staple may easily fall off, necessitating time and labor for re-stapling.

SUMMARY OF THE INVENTION

One aspect of the present invention is directed to a mechanism that can adaptively vary the maximum number of staplable sheets according to a page turning-over direction of sheets to be stapled.

According to an aspect of the present invention, a control apparatus that controls a stapling unit configured to staple sheets includes a control unit configured to determine a turning-over direction of sheets to be stapled by the stapling unit and to determine a maximum number of staplable sheets according to the determined turning-over direction.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 3A, 3B, 3C, and 3D illustrate stapling examples in the image forming apparatus.

FIG. 4 illustrates a stapling table stored in a storage unit illustrated in FIG. 1.

FIGS. 5A, 5B, 5C, 5D, 5E, and 5F illustrate stapling states of the image forming apparatus.

DESCRIPTION OF THE EMBODIMENTS

Various exemplary embodiments, features, and aspects of the invention will be described in detail below with reference to the drawings.

Figure 1:
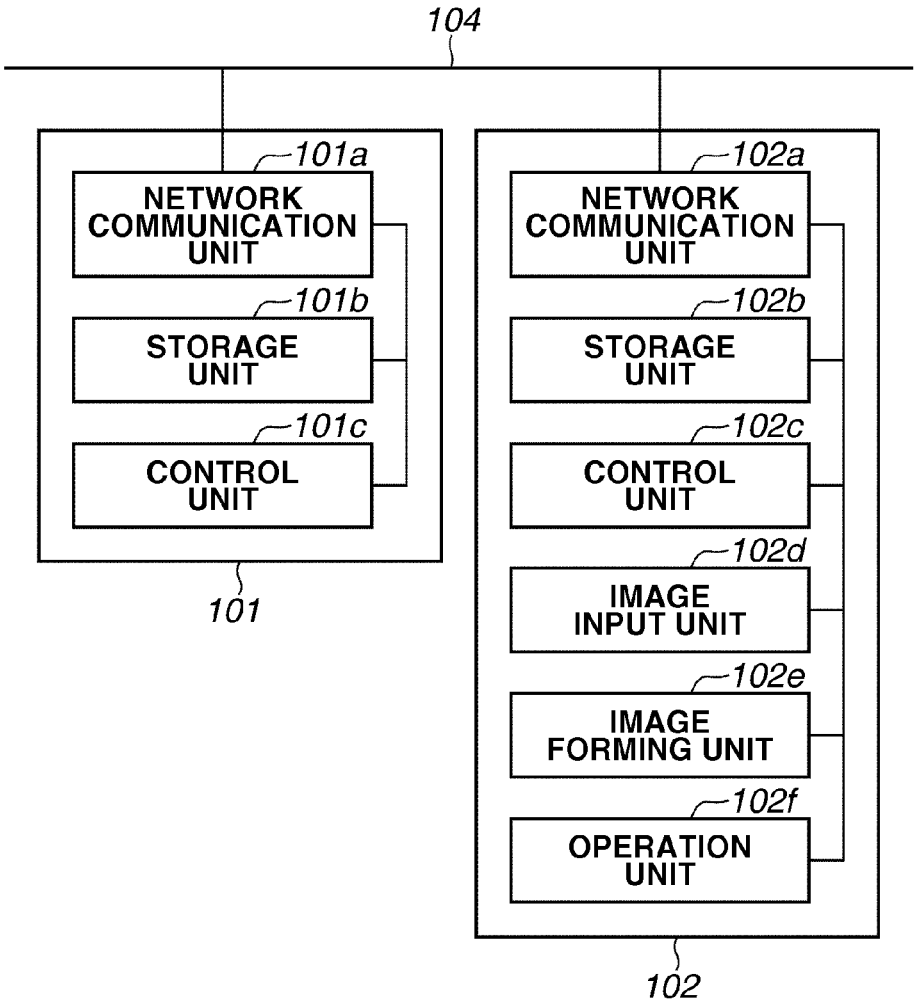
FIG. 1 is a block diagram illustrating a printing system that includes an image forming apparatus according to an exemplary embodiment of the present invention.

FIG. 1 is a block diagram illustrating a printing system that includes an image forming apparatus according to the exemplary embodiment of the present invention. The image forming apparatus is described by taking an example of a multifunction peripheral that has a printing function, a scanner function, and a communication function. However, the present invention can be applied to a printing apparatus.

In FIG. 1, an external apparatus 101 is a desktop PC or a notebook PC. An image forming apparatus 102 is connected to the external apparatus 101 via a network 104 to be able to carry out bidirectional communication. The network 104 can be a wired or wireless local area network (LAN) to enable direct connection, or the Internet.

The external apparatus 101 includes a central processing unit (CPU), a read-only memory (ROM), a random access memory (RAM), and a hard disk drive (HDD). The CPU reads a program group or print data necessary for each program (including printer driver) stored in the HDD onto the RAM to execute the program, thereby achieving a function of each unit.

A network communication unit 101*a* transmits the print data and print settings to the image forming apparatus 102, and receives apparatus information or a printing result from the image forming apparatus 102. A storage unit 101*b* is a ROM, a RAM, or a HDD. The print data or information regarding the print settings is stored in the ROM, the RAM, or the HDD.

A control unit 101*c*, each function processing of which is achieved by the CPU, executes a control program (e.g., document creation application or printer driver) read from the storage unit 101*b* by the CPU. The control unit 101*c* reads the print data and a print setting value from the storage unit 101*b* to transmit them to the image forming apparatus 102 via the network communication unit 101*a*. This control unit also functions as a control apparatus to control stapling.

The image forming apparatus 102 includes a CPU, a ROM, a RAM, and a HDD. The CPU reads a program group, print data necessary for each program, or screen resources stored in the HDD onto the RAM to execute the program, thereby achieving a function of each unit.

A network communication unit 102*a* receives the print data or the print setting value from the external apparatus 101, and transmits the apparatus information or the printing result of the image forming apparatus 102 to the external apparatus 101.

A storage unit 102*b* is a ROM, a RAM, or a HDD. The storage unit 102*b* stores the print data or the print setting value received from the external apparatus 101, print data read from an image input unit 102*d* represented by a scanner, a print setting value input from an operation unit 102*f*, and each program or the screen resources of the image forming apparatus 102.

A control unit 102*c*, each function processing of which is achieved by the CPU, executes a control program read from the storage unit 102*b* by the CPU. The control unit 102*c* detects a printing start instruction from the operation unit 102*f* operated by a user, generates a print job (e.g., copy job) according to the print settings input from the operation unit 102*f*, and stores the print data read from an image input unit 102*d*.

The control unit 102*c* receives the print data and the print settings from the external apparatus 101 via the network communication unit 102*a* to generate a print job (e.g., page description language (PDL) print job). The control unit 102*c* executes control to store the print data in the storage unit 102*b*. The print job is configured to designate a stapling position on a user interface (UI) screen such as a printer driver installed in the external apparatus.

The control unit 102*c* also executes control to read print data according to each print job from the storage unit 102*b* and form an image on recording paper by an image forming unit 102*e*. Thus, the control unit 102*c* is in overall control of processes of the respective units for printing.

Figure 6:
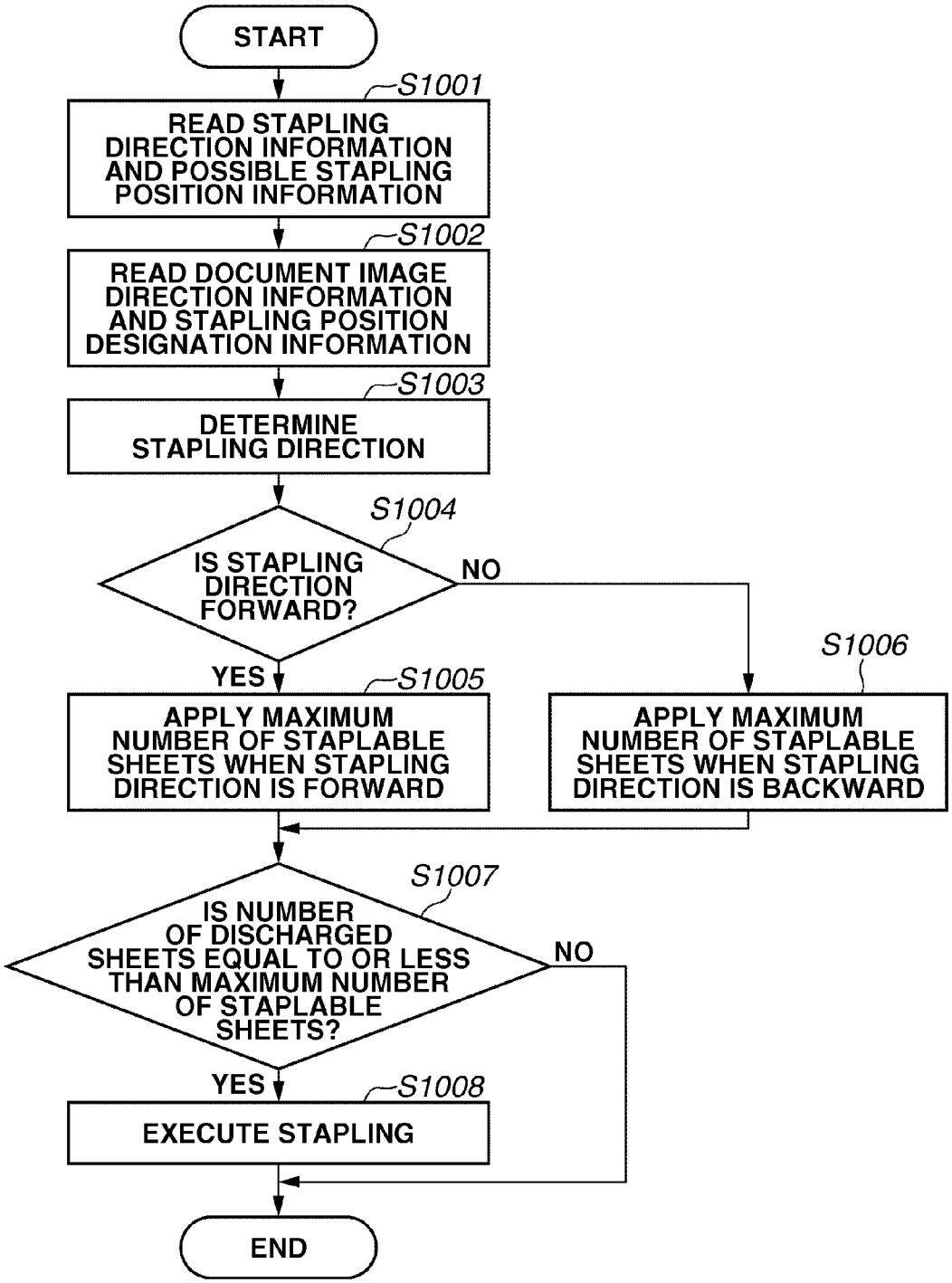
FIG. 6 is a flowchart illustrating a control method of the image forming apparatus.
Figure 7:
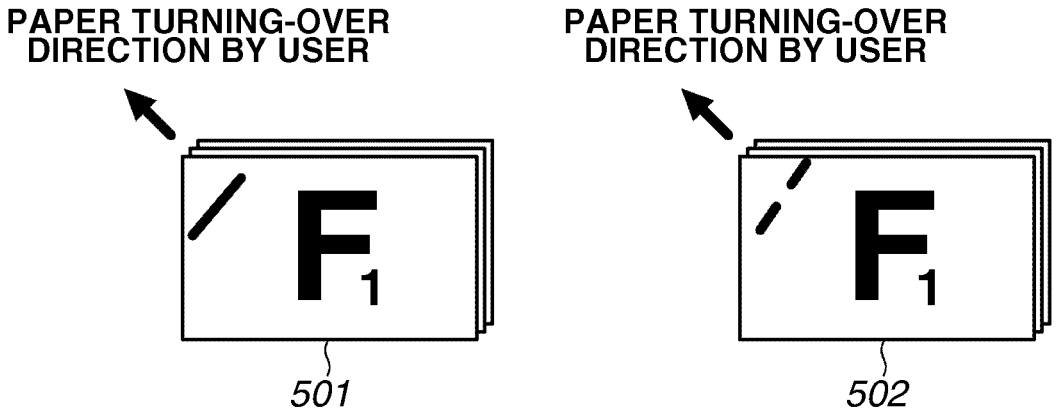
FIG. 7 illustrates a stapling state of the image forming apparatus.

The control unit 102*c* executes control illustrated in FIG. 6 when a discharged set of sheets is stapled according to print settings set in a print job. Specifically, the control unit 102*c* executes, according to a procedure illustrated in FIG. 6, control to vary the maximum number of staplable sheets to be set in a stapling unit 212 by determining a page turning-over direction of the set of sheets to be stapled by the stapling unit 212.

Figure 2:
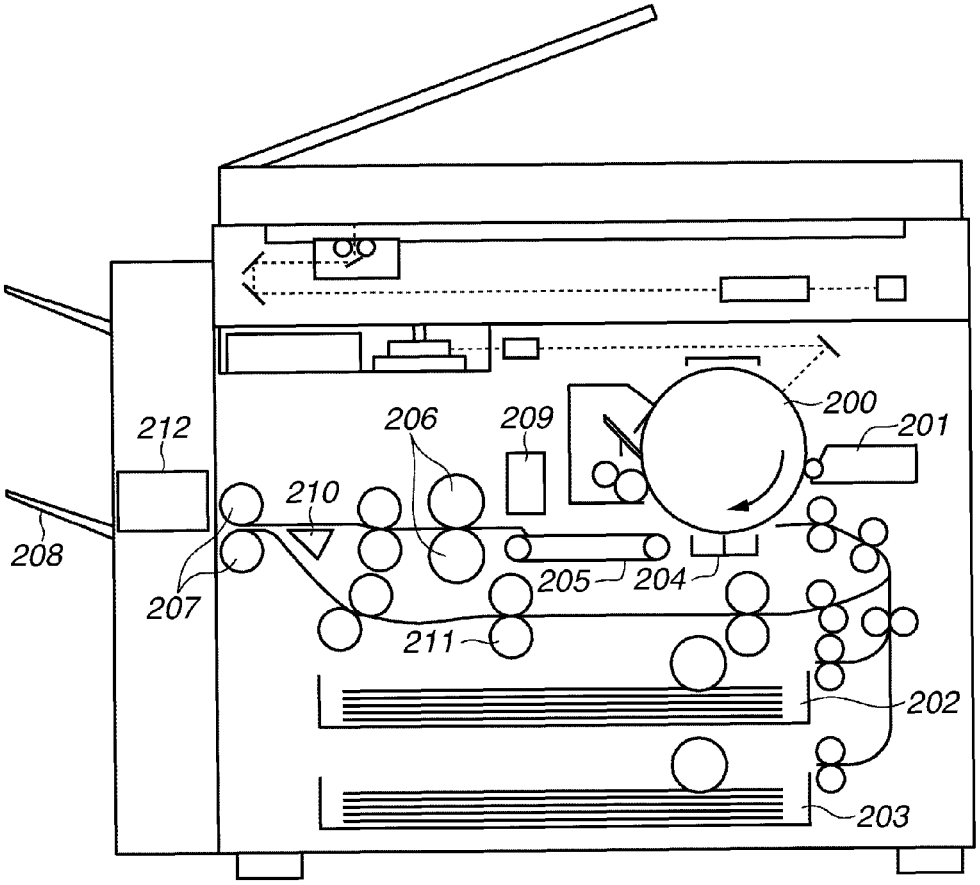
FIG. 2 is a schematic sectional view illustrating an example of an image forming unit illustrated in FIG. 1.

FIG. 2 is a schematic sectional view illustrating an example of an image forming unit 102*e* illustrated in FIG. 1.

In FIG. 2, the control unit 102*c* prints print data at the image forming unit 102*e* that is a printer engine. In this case, the print data itself, a control command, or a status of the image forming unit 102*e* is transferred between the control unit 102*c* and the image forming unit 102*e*. One of such statuses is mechanical configuration information of the stapling unit 212 included in the image forming unit 102*e*.

The control unit 102*c* acquires, before a start of printing, the mechanical configuration information of the stapling unit 212 to record it in the storage unit 102*b*. The mechanical configuration information of the stapling unit 212 is described below referring to FIGS. 3A to 3D.

The image forming unit 102*e* determines whether sheets can be fed in response to a sheet feeding request received from the control unit 102*c*. Having determined that the sheets can be fed, the image forming unit 102*e* transmits a sheet feedable status to the control unit 102*c*. The control unit 102*c* then irradiates a photosensitive drum 200 with a laser beam according to the print data to form a latent image based on the print data, and deposits toner in a developing device 201 on the latent image part of the photosensitive drum 200.

When synchronized with the start of irradiation of the laser beam, the image forming unit 102*e* feeds recording paper from one of sheet feeding cassettes 202 and 203 to a transfer unit 204 to transfer the toner deposited on the photosensitive drum 200 to the recording paper.

The image forming unit 102*e* then conveys the recording paper to which the toner has been transferred from an intermediate transfer belt 205 to a fixing unit 206, and fixes the toner on the recording paper by heat and pressure of the fixing unit 206. The image forming unit 102*e* executes preprocessing before reception of printing, such as a temperature increase of the fixing unit, before the start of printing, and transmits a status during the preprocessing to the control unit 102*c*.

After completion of the printing, the image forming unit 102*e* executes post-processing such as a temperature decrease after completion of the print job, and transmits a status during the post-processing to the control unit 102*c*. The recording paper passed through the fixing unit 206 is discharged by a discharge roller 207, and passed through the stapling unit 212 to be discharged to a discharge tray 208. The image forming unit 102*e* conveys waste toner left after the transfer to the recording paper to a waste toner container 209.

When two-sided printing is designated in the print job, the recording paper on a first surface of which data has been printed and which has been conveyed to the discharge roller 207 is guided, by a flapper 210, to a sheet re-feeding conveyance path 211 by reversing a rotational direction of the discharge roller 207, and conveyed from the sheet re-feeding conveyance path 211 to the transfer unit 204.

The image forming unit 102*e* discharges the recording paper on a second surface of which data has been printed by the discharge roller 207. The recording sheet is then processed through the stapling unit 212 to be discharged to the discharge tray 208. When sheet feeding is inhibited, a sheet nonfeedable status is transmitted to the control unit 102*c*, and control is executed not to perform any operation such as sheet feeding, conveyance, transfer, or fixing of the latent image.

On the other hand, when the image forming apparatus 102 receives from the external apparatus 101 a print job having stapling designated in the print settings, the control unit 102*c* controls the stapling unit 212 to staple the recording paper.

In this case, the control unit 102*c* controls the stapling unit 212 to keep the recording paper on an internal tray until the number of recording sheets to be stapled is reached. Having determined that the number of recording sheets to be stapled has been reached, the control unit 102*c* controls the stapling unit 212 to execute stapling, and discharges stapled recording papers to the discharge tray 208.

FIGS. 3A, 3B, 3C, and 3D illustrate stapling examples at the image forming apparatus according to this exemplary embodiment. A mechanical configuration of the stapling unit is described.

FIGS. 3A and 3B illustrate stapling direction information indicating directions of driving a staple 301 by the stapling unit 212 illustrated in FIG. 2 with respect to a conveying direction of the recording paper.

FIG. 3A illustrates a mechanical configuration example where the stapling unit 212 drives the staple 301 upward in a trailing edge, with respect to the conveying direction of the recording paper, of the set of recording papers 300. FIG. 3B illustrates a mechanical configuration example where the stapling unit 212 drives the staple 301 downward in the trailing edge, with respect to the conveying direction of the recording paper, of the set of recording papers 300.

In this exemplary embodiment, it is presumed that the stapling direction information is stored in the storage unit 102*b* illustrated in FIG. 1. The control unit 102*c* is accordingly configured to read the stapling direction information from the storage unit 102*b* when executing stapling.

FIGS. 3C and 3D illustrate possible stapling position information indicating physical positions where the stapling unit 212 can staple the set of recording papers 300.

FIG. 3C illustrates a mechanical configuration example where the stapling unit 212 having a mechanism for moving a stapling part can drive a staple at one of a front side position 302 and a rear side position 303 by moving the stapling part.

On the other hand, FIG. 3D illustrates a mechanical configuration example where the stapling unit 212 having no mechanism for moving the stapling part can drive a staple only at the front side position 302.

In this exemplary embodiment, it is presumed that the possible stapling position information is stored in the storage unit 102*b*. The control unit 102*c* is accordingly configured to read the possible stapling position information from the storage unit 102*b* when executing stapling.

FIG. 4 illustrates an example of a stapling table stored in the storage unit 102*b* illustrated in FIG. 1. This is specifically an example of a sheet discharging operation determination table used for discharge control of the control unit 102*c* during stapling. The control unit 102*c* reads the stapling table during the stapling operation illustrated in FIG. 4 from the storage unit 102*b* to determine a sheet discharging method.

In the example illustrated in FIG. 4, a document image is a portrait image or a landscape image of an A4 size, and recording paper of an A4 size can be fed from one of the sheet feeding cassettes 202 and 203 only in a vertical direction (where a long side is parallel to a conveying direction).

Each of "stapling direction information" and "possible stapling position information" illustrated in FIG. 4 is defined to be one of the mechanical configurations of the stapling unit illustrated in FIGS. 3A to 3D. "Document image direction information" and "stapling position designation information" are included in the print settings designated in the print job received from the external apparatus 101. The print settings include stapling information to designate which position of a set of papers is stapled.

The control unit 102*c* can determine a stapling position (front or rear) and a stapling direction based on the stapling direction information, the possible stapling position information, and the document image direction information and the stapling position designation information included in the print settings.

For the stapling direction, a stapling direction where recording paper on which a first page of a document has been printed to recording paper on which a last page of the document has been printed are stapled is defined as "forward".

On the other hand, a stapling direction where recording paper on which the last page of the document has been printed to the recording paper on which the first page of the document has been printed are stapled is defined as "backward".

There is an image forming apparatus that can feed a sheet of an A4 size from one of the sheet feeding cassettes 202 and 203 not only in a vertical direction but also in a horizontal direction.

In such an image forming apparatus, the control unit 102*c* can appropriately print a document image on both vertically and horizontally fed recording sheets by rotating the document image 90 degrees according to sheet feeding directions. In this case, a stapling table different from that illustrated in FIG. 4 can be applied.

FIGS. 5A, 5B, and 5C illustrate sheet discharge control examples during stapling by the control unit 102*c* that uses the stapling table illustrated in FIG. 4.

FIG. 5A illustrates an example where mechanical configurations of the stapling unit 212 are those illustrated in FIGS. 3A and 3D, and stapling position designation information and a document image direction included in the print settings are respectively upper left and a portrait.

In this case, the control unit 102*c* executes control to print images on recording paper sequentially from a first page to a last page of a document (in page ascending order). The control unit 102*c* controls sheet discharging so that a printing surface can be a lower side of the recording paper to be discharged (face-down).

FIG. 5D illustrates a result of stapling carried out under the sheet discharge control illustrated in FIG. 5A. In FIG. 5D, recording paper on which the first page of the document has been printed to recording paper on which the last page of the document has been printed are stapled (forward direction).

FIG. 5B illustrates an example where mechanical configurations of the stapling unit 212 are those illustrated in FIGS. 3A and 3C, and stapling position designation information and a document image direction included in the print settings are respectively upper left and a landscape. In this case, the control unit 102*c* executes control to print images on recording paper sequentially from a first page to a last page of a document (in page ascending order). The control unit 102*c* controls sheet discharging so that a printing surface can be a lower side of the recording paper to be discharged (face-down).

FIG. 5E illustrates a result of stapling carried out under the sheet discharge control illustrated in FIG. 5B. In FIG. 5E, recording paper on which the first page of the document has been printed to recording paper on which the last page of the document has been printed are stapled (forward direction).

FIG. 5C illustrates an example where mechanical configurations of the stapling unit 212 are those illustrated in FIGS. 3A and 3D, and stapling position designation information and a document image direction included in the print settings are respectively upper left and a landscape. In this case, the control unit 102*c* executes control to print images on recording paper sequentially from a last page to a first page of a document (in page descending order) because of restrictions illustrated in FIGS. 3A and 3D. The control unit 102*c* controls sheet discharging so that a printing surface can be an upper side of the recording paper to be discharged (face-up).

The control unit 102*c* can achieve face-up sheet discharging by executing two-sided output control to print the document image on a rear surface while a front surface is blank by using the sheet re-feeding conveyance path 211 illustrated in FIG. 2. FIG. 5F illustrates a result of stapling carried out under the sheet discharge control illustrated in FIG. 5C. In FIG. 5F, recording paper on which the last page of the document has been printed to recording paper on which the first page of the document has been printed are stapled (backward direction).

When the stapling direction is backward, the staple is fixed on a recording paper surface side on which the first page of the document has been printed. Thus, in the backward direction, a sticking part of the staple becomes shorter at the stapling portion as the number of recording sheets is larger. As a result, stapling strength is gradually reduced.

The control unit 102*c* accordingly determines, referring to the table illustrated in FIG. 4, a stapling direction based on a combination of the stapling direction information, the possible stapling position information, the document image direction information, and stapling position setting information.

FIG. 6 is a flowchart illustrating a control method of the image forming apparatus according to this exemplary embodiment.

The illustrated processing is an example of stapling carried out by the control unit 102*c*. The control unit 102*c* achieves each step by executing the control program stored in the storage unit 102*b* referring to the stapling table illustrated in FIG. 4. Hereinafter, the stapling including determination of a page turning-over direction, which is carried out by the control unit 102*c* based on a stapling direction of a set of sheets and page ascending or descending orders of the set of sheets, is described.

In step S1001, the control unit 102*c* reads, from the storage unit 102*b*, "stapling direction information" and "possible stapling position information" that have been acquired before printing.

In step S1002, the control unit 102*c* reads "document image direction information" and "stapling position designation information" included in the print settings.

In step S1003, the control unit 102*c* determines a stapling direction based on the "stapling direction information", the "possible stapling position information", the "document image direction information", and the "stapling position designation information".

In step S1004, the control unit 102*c* determines whether the stapling direction is forward.

When the stapling direction is determined to be forward (YES in step S1004), in step S1005, the control unit 102*c* reads the "maximum number of staplable sheets in forward direction" from the storage unit 102*b*.

On the other hand, when the stapling direction is backward (NO in step S1004), in step S1006, the control unit 102*c* reads the "maximum number of staplable sheets in backward direction" from the storage unit 102*b*.

In the present exemplary embodiment, the "maximum number of staplable sheets in backward direction" is smaller than the "maximum number of staplable sheets in forward direction".

In step S1007, the control unit 102*c* determines whether the number of recording sheets (total number of recording sheets in one print job) stored by the stapling unit 212 is equal to or less than the maximum number of staplable sheets.

When the number of stored recording sheets is equal to or less than the maximum number of staplable sheets (YES in step S1007), in step S1008, the control unit 102*c* controls the stapling unit 212 to staple the set of recording papers. Then, the processing ends.

On the other hand, when the number of stored recording sheets is larger than the maximum number of staplable sheets (NO in step S1007), the control unit 102*c* controls the stapling unit 212 to discharge the sheets to the discharge tray 208 without stapling. Then, the processing ends.

The image forming apparatus can therefore vary the maximum number of staplable sheets used for stapling determination depending on a stapling direction. As a result, when stapling is executed in a direction reverse to a sheet turning-over direction, and the number of sheets increases, control can be performed not to execute stapling on the number of sheets smaller than the maximum number of staplable sheets in the forward direction.

Thus, stapling where staple falling-off is difficult to occur when the user turns over the sheets of the stapled set of sheets from the backward direction can be achieved.

When the processing ends from step S1005, control to give a message indicating that no stapling has been executed to the user can be added to the operation unit 102*f*.

In an image forming apparatus that includes a sheet inserting function such as an inserter, control to further increase/decrease the maximum number of sheets used for the determination can be added in view of a thickness and the number of sheets inserted from the inserter.

According to the present exemplary embodiment, the number of staplable sheets during stapling can be varied adaptively according to the turning-over direction of the set of sheets.

Aspects of the present invention can also be realized by a computer of a system or apparatus (or devices such as a CPU or MPU) that reads out and executes a program recorded on a memory device (computer-readable storage medium) to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium). In such a case, the system or apparatus, and the recording medium where the program is stored, are included as being within the scope of the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-093275 filed Apr. 19, 2011, which is hereby incorporated by reference herein in its entirety.

What is claimed is:

1. An image forming apparatus that controls a stapling unit configured to staple sheets, the image forming apparatus comprising:

an image forming unit configured to form images on sheets to be stapled by the stapling unit; and a control unit configured to determine a turning-over direction of sheets to be stapled by the stapling unit and to determine a maximum number of staplable sheets according to the determined turning-over direction.

2. The image forming apparatus according to claim 1, wherein the control unit determines the turning-over direction based on page ascending or descending orders of the sheets.

3. The image forming apparatus according to claim 1, wherein the maximum number of staplable sheets when a stapling direction is similar to the turning-over direction is smaller than that when the stapling direction is different from the turning-over direction.

4. The image forming apparatus according to claim 1, wherein a position of stapling the sheets by the stapling unit is determined based on stapling information set in a print job.

5. A control apparatus that controls a stapling function, the control apparatus comprising:

a storage unit configured to store a program; and a processing unit configured to execute the program to determine a turning-over direction of the sheets to be stapled and to determine a maximum number of staplable sheets according to the determined turning-over direction.

6. The control apparatus according to claim 5, wherein the processing unit determines the turning-over direction based on page ascending or descending orders of the sheets.

7. The control apparatus according to claim 5, wherein the maximum number of staplable sheets when a stapling direction is similar to the turning-over direction is smaller than that when the stapling direction is different from the turning-over direction.

8. The control apparatus according to claim 5, wherein a position of stapling the sheets is determined based on stapling information set in a print job.

9. A method for controlling a stapling function, the method comprising:

determining a turning-over direction of sheets to be stapled; and determining a maximum number of staplable sheets according to the determined turning-over direction.

10. The method according to claim 9, wherein the turning-over direction is determined based on page ascending or descending orders of the sheets.

11. The control apparatus according to claim 9, wherein the maximum number of staplable sheets when a stapling direction is similar to the turning-over direction is smaller than that when the stapling direction is different from the turning-over direction.

12. The control apparatus according to claim 9, wherein a position of stapling the sheets by the stapling unit is determined based on stapling information set in a print job.

13. A computer-readable storage medium storing a program for causing a computer to control a stapling function, the program comprising:

determining a turning-over direction of sheets to be stapled; and determining a maximum number of staplable sheets according to the determined turning-over direction.

* * * * *